US009793664B2

(12) United States Patent
Valenti

(10) Patent No.: US 9,793,664 B2
(45) Date of Patent: Oct. 17, 2017

(54) COMMUNICATION CONNECTORS

(71) Applicant: Panduit Corp., Tinley Park, IL (US)

(72) Inventor: Joshua A. Valenti, Wheeling, IL (US)

(73) Assignee: Panduit Corp., Tinley Park, IL (US)

( * ) Notice: Subject to any disclaimer, the term of this patent is extended or adjusted under 35 U.S.C. 154(b) by 23 days.

(21) Appl. No.: 15/067,274

(22) Filed: Mar. 11, 2016

(65) Prior Publication Data

US 2017/0264058 A1 Sep. 14, 2017

(51) Int. Cl.

| | |
|---|---|
| ***H01R 24/00*** | (2011.01) |
| ***H01R 24/64*** | (2011.01) |
| ***H01R 12/57*** | (2011.01) |
| *H01R 107/00* | (2006.01) |

(52) U.S. Cl.
CPC ..... *H01R 24/64* (2013.01); *H01R 12/57* (2013.01); *H01R 2107/00* (2013.01)

(58) Field of Classification Search
CPC ... H01R 23/025; H01R 13/6658; H01R 31/06
USPC ..... 439/676, 76.1, 638, 946
See application file for complete search history.

(56) References Cited

U.S. PATENT DOCUMENTS

| | | | | |
|---|---|---|---|---|
| 7,762,839 | B2 * | 7/2010 | Chen | H01R 4/2416 439/540.1 |
| 7,811,093 | B2 * | 10/2010 | Timmins | H04Q 1/13 439/49 |
| 7,993,143 | B2 * | 8/2011 | Nordin | H04Q 1/14 439/49 |
| 9,450,335 | B2 * | 9/2016 | Valenti | F16B 2/22 |
| 9,590,369 | B2 * | 3/2017 | Valenti | H01R 25/006 |

* cited by examiner

*Primary Examiner* — Phuongchi T Nguyen
(74) *Attorney, Agent, or Firm* — Christoper S. Clancy; James H. Williams; Ryan K. Thelen

(57) ABSTRACT

In an embodiment, the present invention is a communication system that includes a communication plug including a plug housing and a plurality of plug contacts positioned at least partially within the plug housing, and a communication jack including a jack housing and a plurality of plug interface contacts (PICs) at least partially positioned within the jack housing. The communication plug and the communication jack are configured to mate together in a first configuration where each of the plug contacts interfaces one of the PICs along the respective plug contact's first section. The communication plug and the communication jack are further configured to mate together in a second configuration where each of the plug contacts interfaces one of the PICs along the respective plug contact's second section, the second section being different than the respective first section.

18 Claims, 22 Drawing Sheets

COMMUNICATION CONNECTORS

FIELD OF INVENTION

The present invention generally relates to the field of network communication, and more specifically, to the field of plug and/or jack connectivity components that can be used in connection with twisted-pair cabling.

BACKGROUND

In recent history, Ethernet communication has primarily been implemented over twisted-pair cabling along with the use of modular connectors to enable appropriate connectivity. To allow for proper interoperability between products produced by different manufacturers, standards like the CAT6, CAT6A, IEC-60603-7:2010, and ANSI/TIA-568-C.2 set out various electrical and physical parameters. Components which comply with these standards are known to work within some predetermined limits, allowing users to build networks out of non-proprietary parts.

While standardized products occupy a large market share, there is still a need for more proprietary designs which may comply with only some standards but not with others. This is the case because some physical limitations placed on hardware by way of existing standards make it difficult to design connectivity components that can operate at relatively high bandwidths. For example, crosstalk produced in an RJ45 plug is typically separated from any crosstalk cancellation circuitry in an RJ45 jack by some distance. At lower operating frequencies (e.g., 100 MHz) this distance may not be much of a concern. However, as the operating frequencies increase to 500 MHz and above, the inherent distance between the crosstalk circuitry and the cancellation circuitry causes a phase shift to occur, hindering effective cancellation of crosstalk and ultimately leading to a degradation in the communication signal.

Non-standardized designs may reduce these concerns as they provide more design freedom. However, due to the overwhelming presence of the currently standardized connectivity components, it is still desirable to have cables and connectors which are backwards compatible with the infrastructure that is currently in place. As such, there is a need for connector designs that provide backward compatibility to some currently established standards while at the same time allowing improved performance if and when they are implemented in a non-standardized way.

SUMMARY

Accordingly, at least some embodiments of the present invention are directed towards connector designs which provide backward compatibility to some currently established standards while at the same time allowing improved performance if and when they are implemented in a non-standardized way.

In an embodiment, the present invention is a communication system that includes a communication plug including a plug housing and a plurality of plug contacts positioned at least partially within the plug housing, and a communication jack including a jack housing and a plurality of plug interface contacts (PICs) at least partially positioned within the jack housing. The communication plug and the communication jack are configured to mate together in a first configuration where each of the plug contacts interfaces one of the PICs along the respective plug contact's first section. The communication plug and the communication jack are further configured to mate together in a second configuration where each of the plug contacts interfaces one of the PICs along the respective plug contact's second section, the second section being different than the respective first section.

In a variation of this embodiment, the communication plug includes a plug printed circuit board (PCB) with a plurality of plug PCB contact pads, each of the plug contacts having a plug-contact base portion secured within the plug PCB and a plug-contact contact leg. The communication jack includes a jack PCB with a plurality of jack PCB contact pads, each of the PICs having a PIC base portion secured within the jack PCB and a PIC contact leg. In the first configuration each of the plug-contact contact legs is in contact with one of the plug PCB contact pads, and each of the PIC contact legs is in contact with one of the jack PCB contact pads. In the first configuration each of the plug-contact contact legs is disconnected from each of the plug PCB contact pads, and each of the PIC contact legs is disconnected from each of the jack PCB contact pads.

In another embodiment, the present invention is a communication jack configured to alternately mate with one of a first type of a communication plug configuration and a second type of a communication plug configuration. The communication jack includes a housing, a PCB having a plurality of contact pads, and a plurality of PICs. At least one of the PICs is in contact with one of the contact pads such that the one of the contact pads is off a current path when the communication jack is mated with the first type of a communication plug configuration, and the at least one of the PICs is disconnected from respective the one of the contact pads when the communication jack is mated with the second type of a communication plug configuration.

In yet another embodiment, the present invention is a communication plug configured to alternately mate with one of a first type of a communication jack configuration and a second type of a communication jack configuration. The communication plug includes a housing, a PCB having a plurality of contact pads, and a plurality of plug contacts. At least one of the plug contacts is in contact with one of the contact pads such that the one of the contact pads is off a current path when the communication plug is mated with the first type of a communication jack configuration, and the at least one of the plug contacts is disconnected from respective the one of the contact pads when the communication plug is mated with the second type of a communication jack configuration.

In still yet another embodiment, the present invention is a communication plug that includes a housing, a PCB, and a plurality of plug contacts secured within the PCB, each of the plug contacts having a static portion and a dynamic portion.

These and other features, aspects, and advantages of the present invention will become better-understood with reference to the following drawings, description, and any claims that may follow.

DETAILED DESCRIPTION

Figure 1:
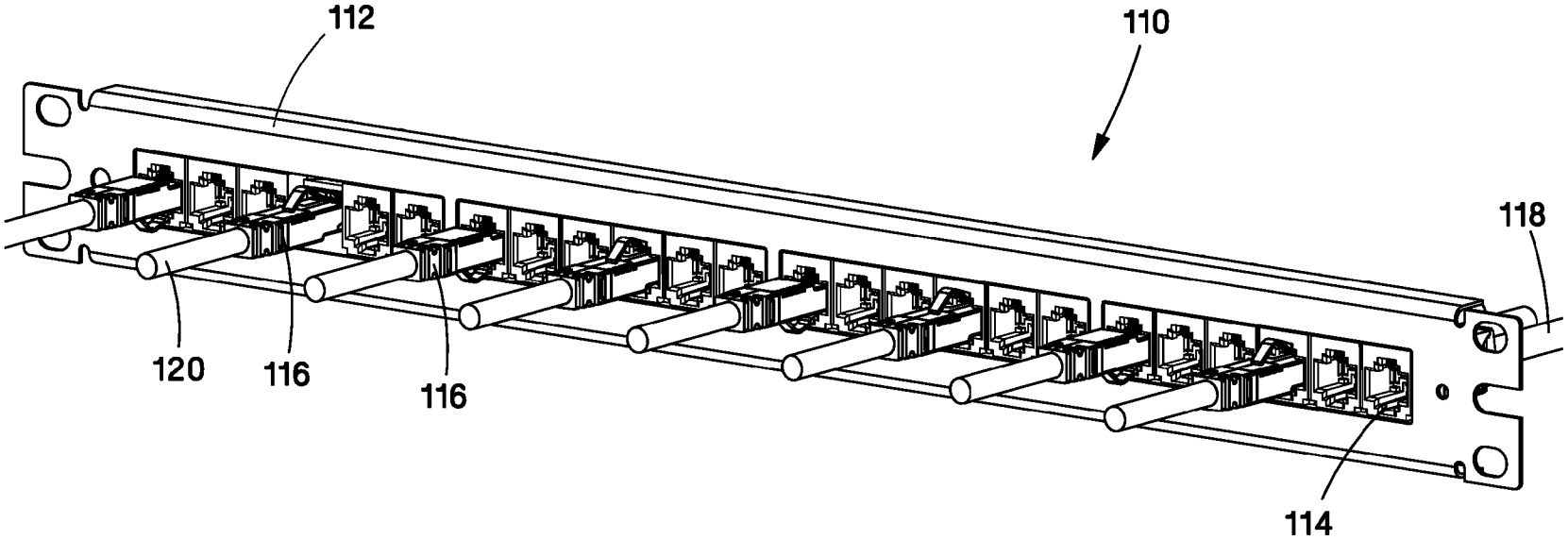
FIG. 1 illustrates a communication system according to an embodiment of the present invention.

FIG. 1 illustrates a communication system 110 according to an embodiment of the present invention which includes patch panel 112 with jacks 114 and corresponding plugs 116. Respective cables 120 are terminated to plugs 116 and respective cables 118 are terminated to jacks 114. Once a plug 116 mates with a jack 114 data can flow in both directions through these connectors. Although communication system 110 is illustrated as a patch panel in FIG. 1, alternatively it can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and/or telecommunications rooms; security devices (cameras and other sensors, etc.) and door access equipment; and telephones, computers, fax machines, printers and other peripherals as can be found in workstation areas. Communication system 110 can further include cabinets, racks, cable management and overhead routing systems, and other such equipment.

Figure 2:
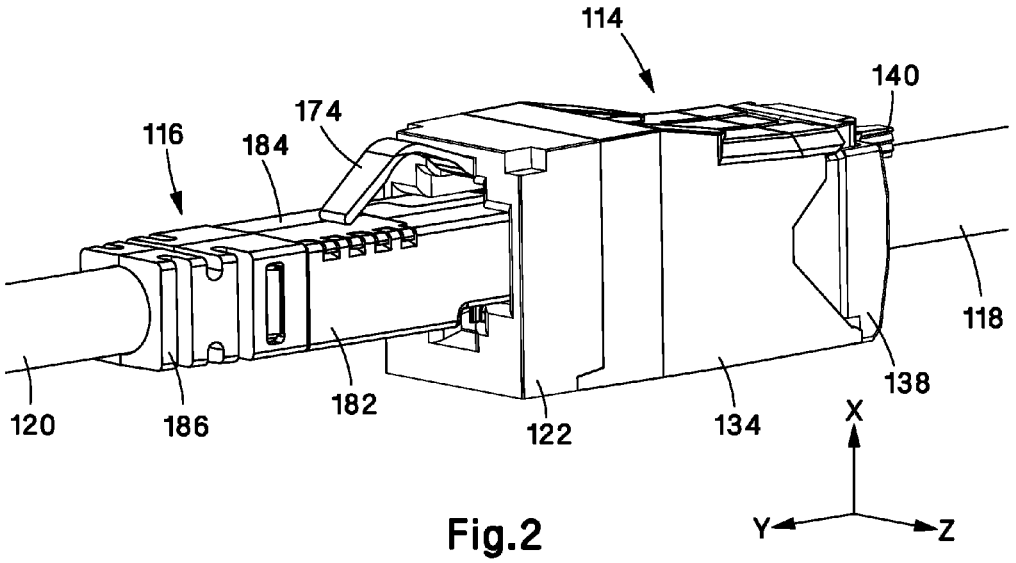
FIG. 2 illustrates a plug in accordance with an embodiment of the present invention and a jack in accordance with an embodiment of the present invention both mated in a first configuration.
Figure 3:
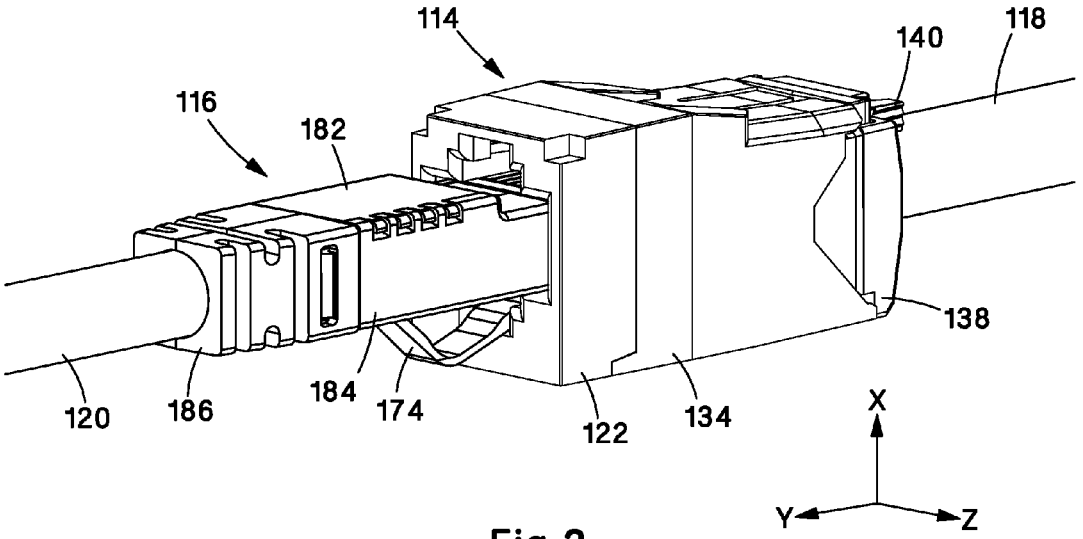
FIG. 3 illustrates a plug in accordance with an embodiment of the present invention and a jack in accordance with an embodiment of the present invention both mated in a second configuration.
Figure 4:
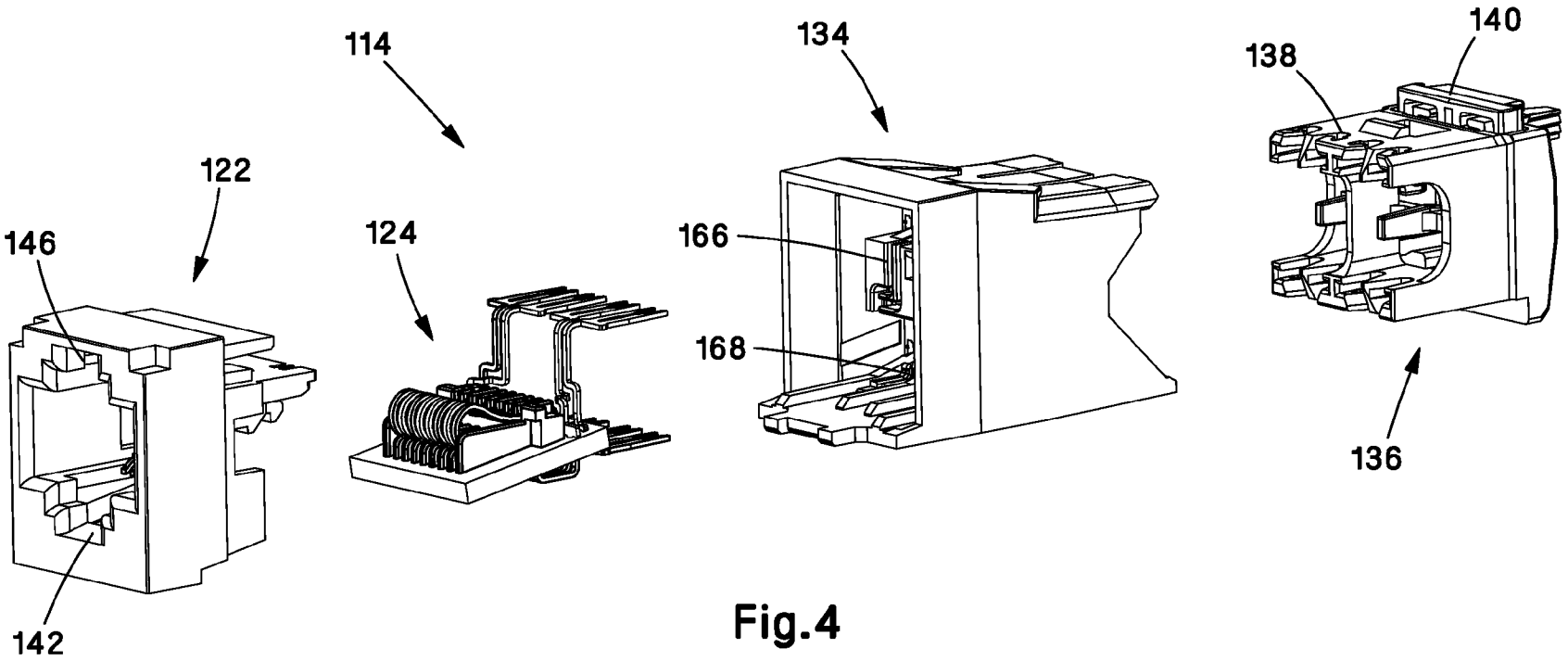
FIGS. 4-6 illustrate isometric exploded views of a jack in accordance with an embodiment of the present invention.
Figure 5:
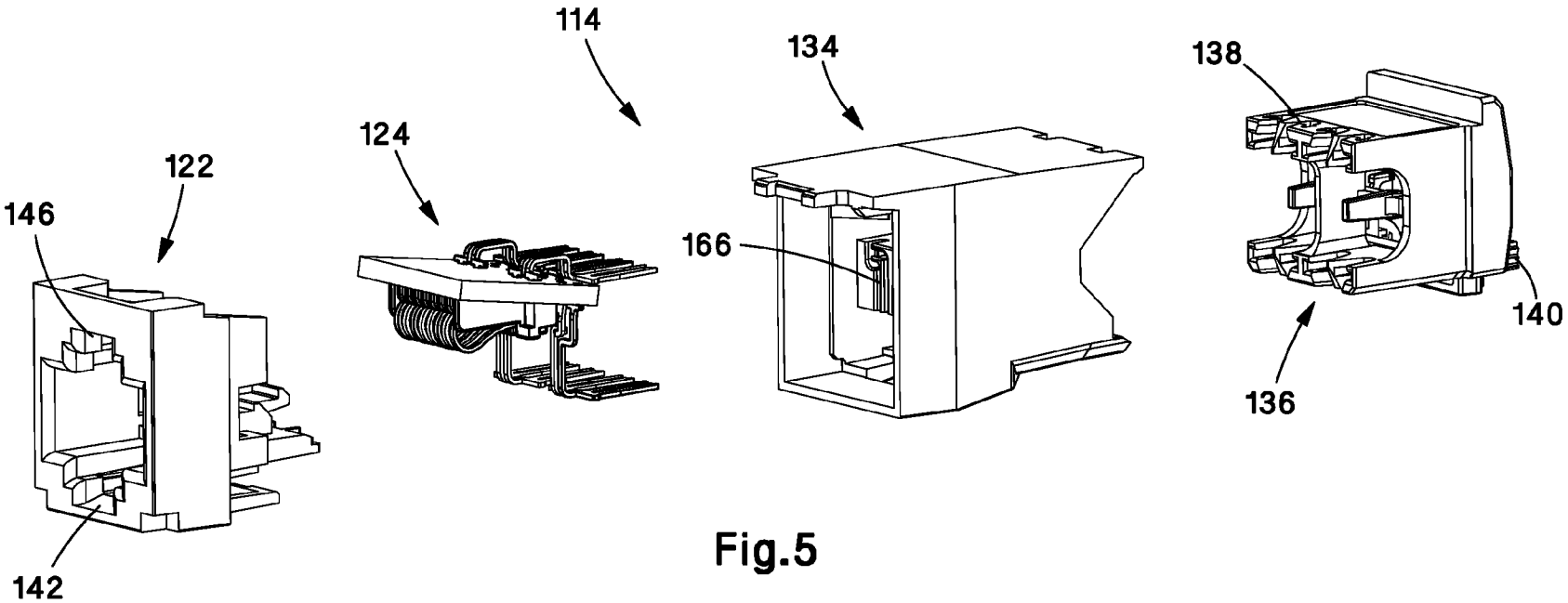
Figure 6:
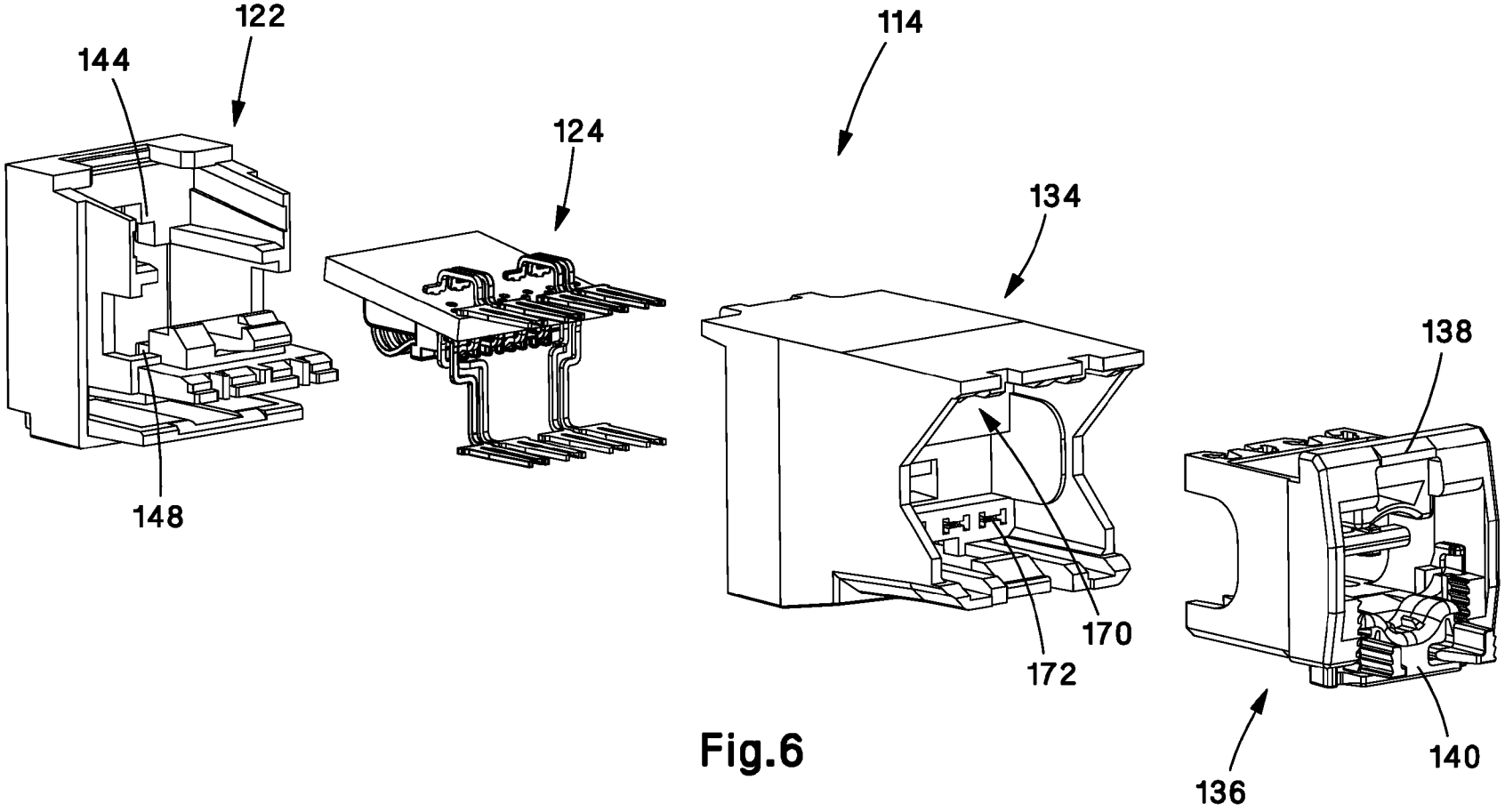
Figure 7:
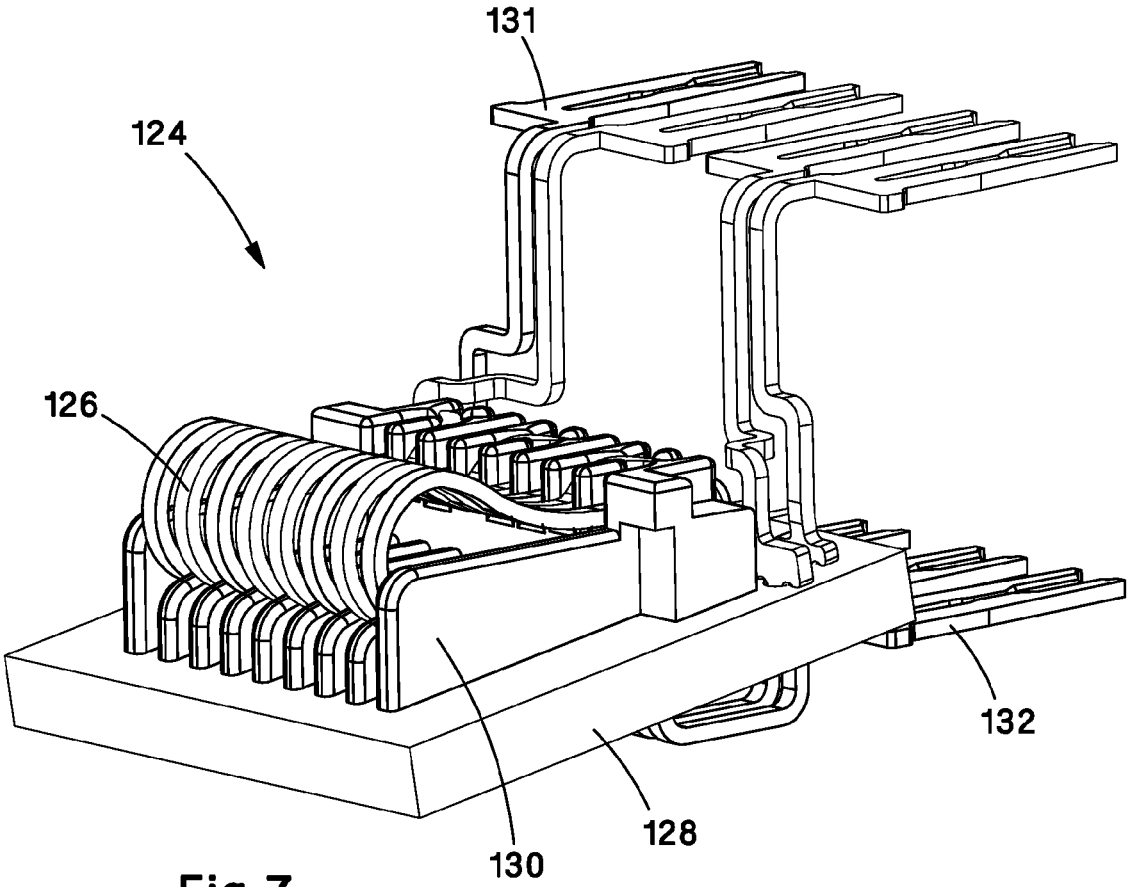
FIGS. 7-9 illustrate isometric views of a sled assembly in accordance with an embodiment of the present invention.
Figure 8:
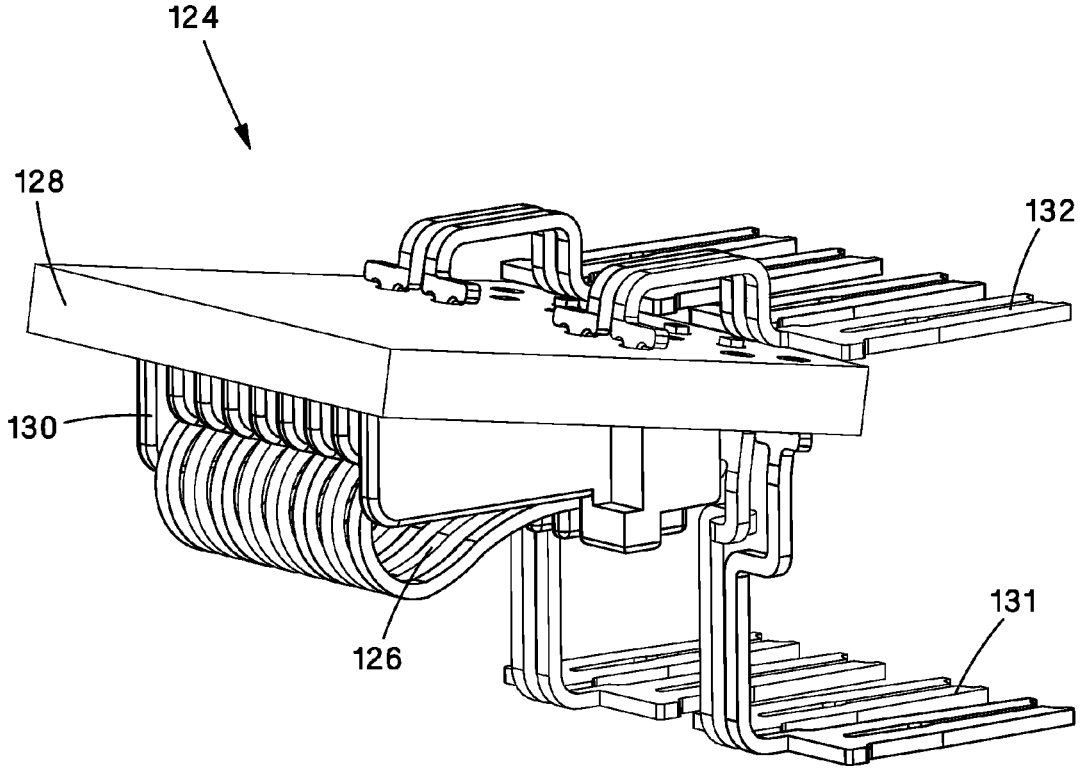
Figure 9:
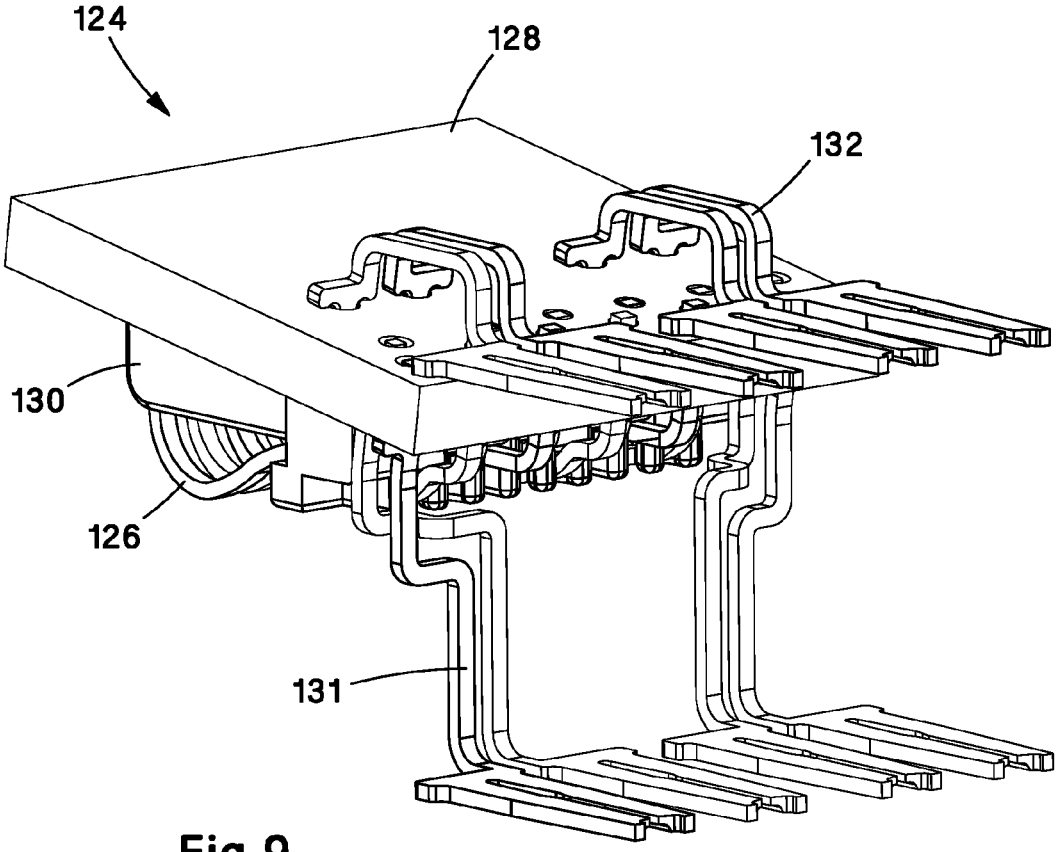
Figure 10:
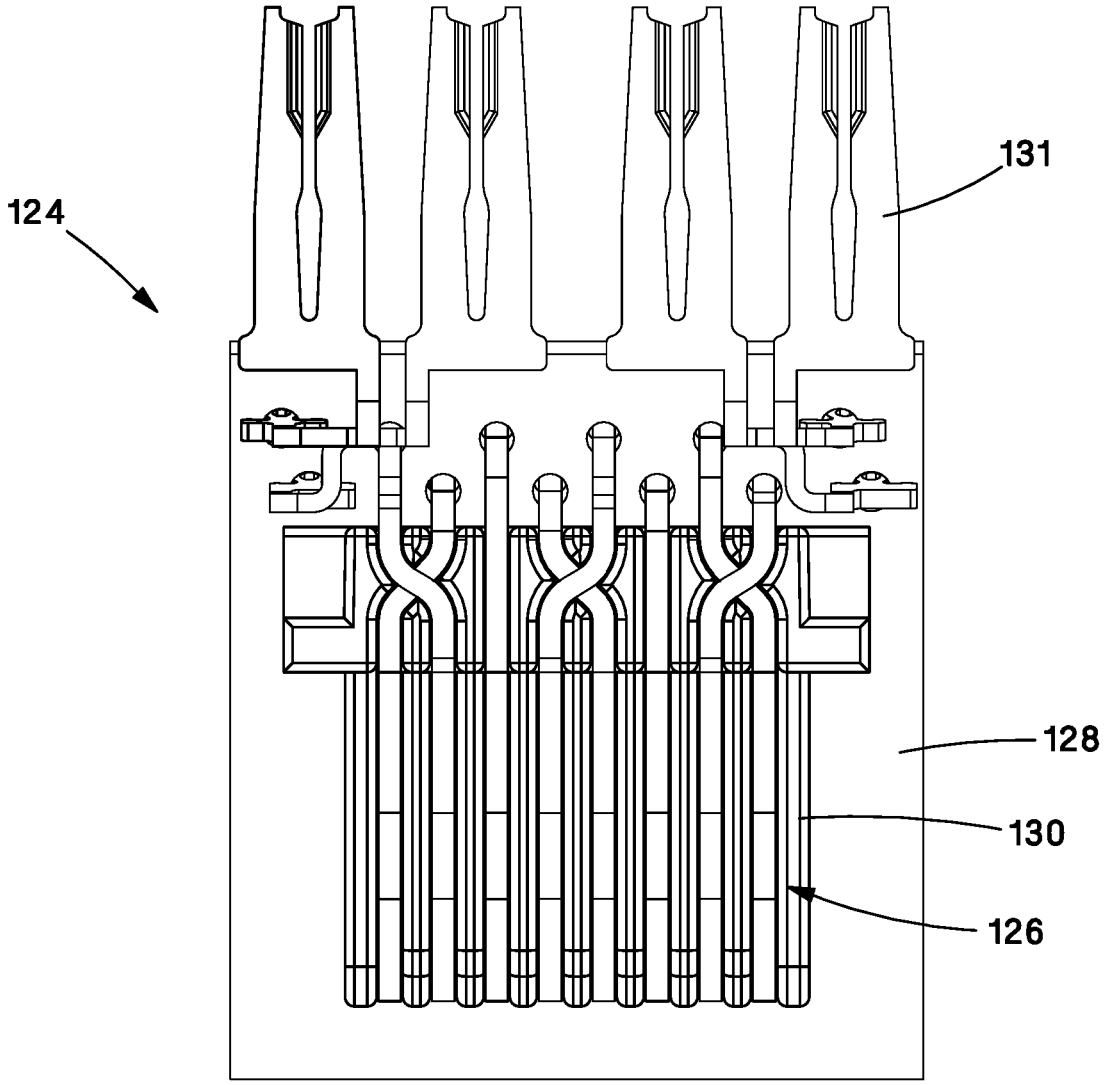
FIG. 10 illustrates a top view of the sled assembly of FIGS. 7-9.

With patch panel 112 remove, FIG. 2 illustrates a plug 116 mated with a jack 114 in a first configuration and FIG. 3 illustrates the same plug 116 mated with the same jack 114 in a second configuration. Both of these mating configurations are also illustrated in FIG. 1. The particular designs of both the plug 116 or the jack 114 allows either one to operate in one of two modes.

Referring to the views shown in FIGS. 4-9, jack 114 includes jack housing 122, sled assembly 124 (which includes plug interface contacts (PICs) 126, printed circuit board (PCB) 128, sled support 130, first set of insulation displacement contacts (IDCs) 131, and second set of IDCs 132), rear sled 134, and wire cap assembly 136 (which includes wire cap 138 and strain relief clip 140). During assembly, sled assembly 124 is trapped between jack housing 122 and rear sled 134. To help support and retain IDCs 131 and 132 in place, rear sled 134 is provided with IDC support features 166, 168 and IDC slots 170, 172 which align with respective IDCs 131 and 132.

Unlike with a typical RJ45 jack, jack 114 allows for a corresponding plug to be inserted in two different orientations. In the first orientation (as shown in FIG. 2) the plug latch 174 is oriented in a first direction along the X-axis; this is referred to as the first mode of operation for jack 114. In the second orientation (as shown in FIG. 3) the plug latch 174 is oriented in a second direction (that is opposite of the first direction) along the X-axis; this is referred to as the second mode of operation for jack 114.

This multi-mode operational nature of jack 114 is enabled by the configuration of the jack housing 122 which includes first latch relief 142 with latch stops 144 and second latch relief 146 with latch stops 148. First latch relief 142 and latch stops 144 are designed to interact with a latch of a plug that conforms to the IEC-60603-7:2010 standard. Second latch relief 146 and latch stops 148 are designed to interact with a latch of a plug that may, but is not required to conform to the IEC-60603-7:2010 standard. As a result, jack housing 122 allows legacy plugs to be mated with jack 114 by allowing the appropriate plug to interact with first latch relief 142 and corresponding latch stops 144.

Figure 11:
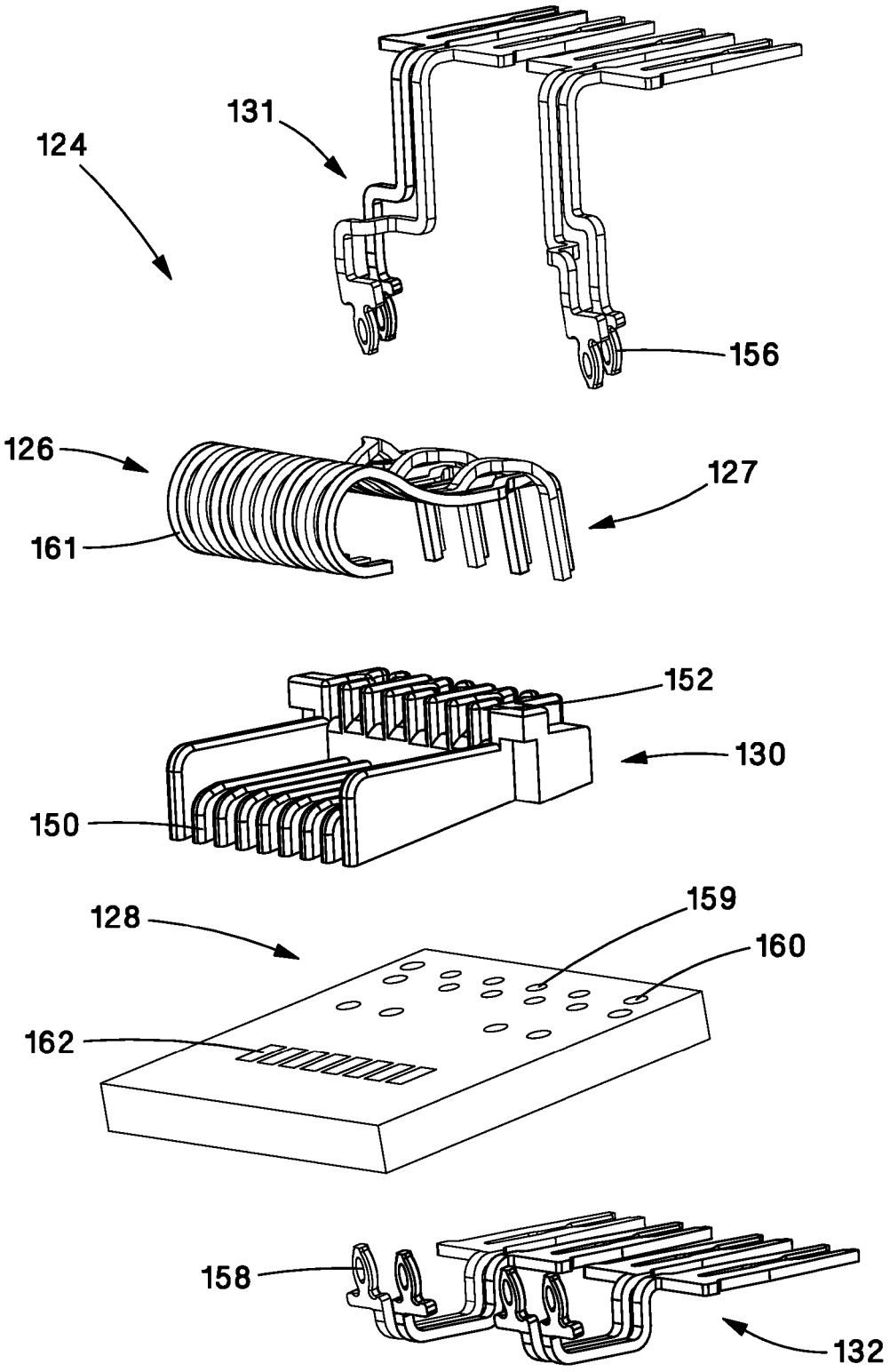
FIGS. 11-13 illustrate isometric exploded views of the sled assembly of FIGS. 7-9.
Figure 12:
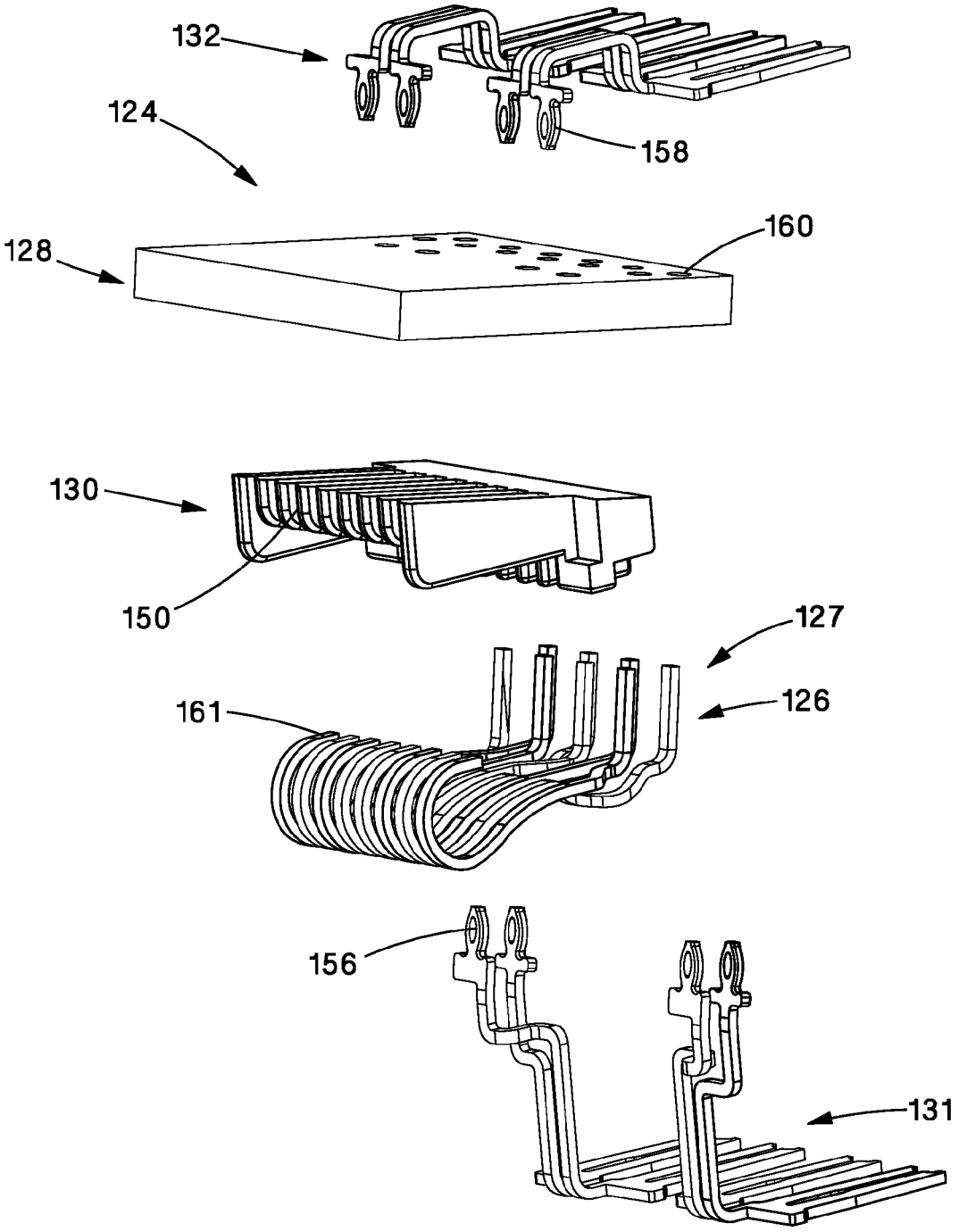
Figure 13:
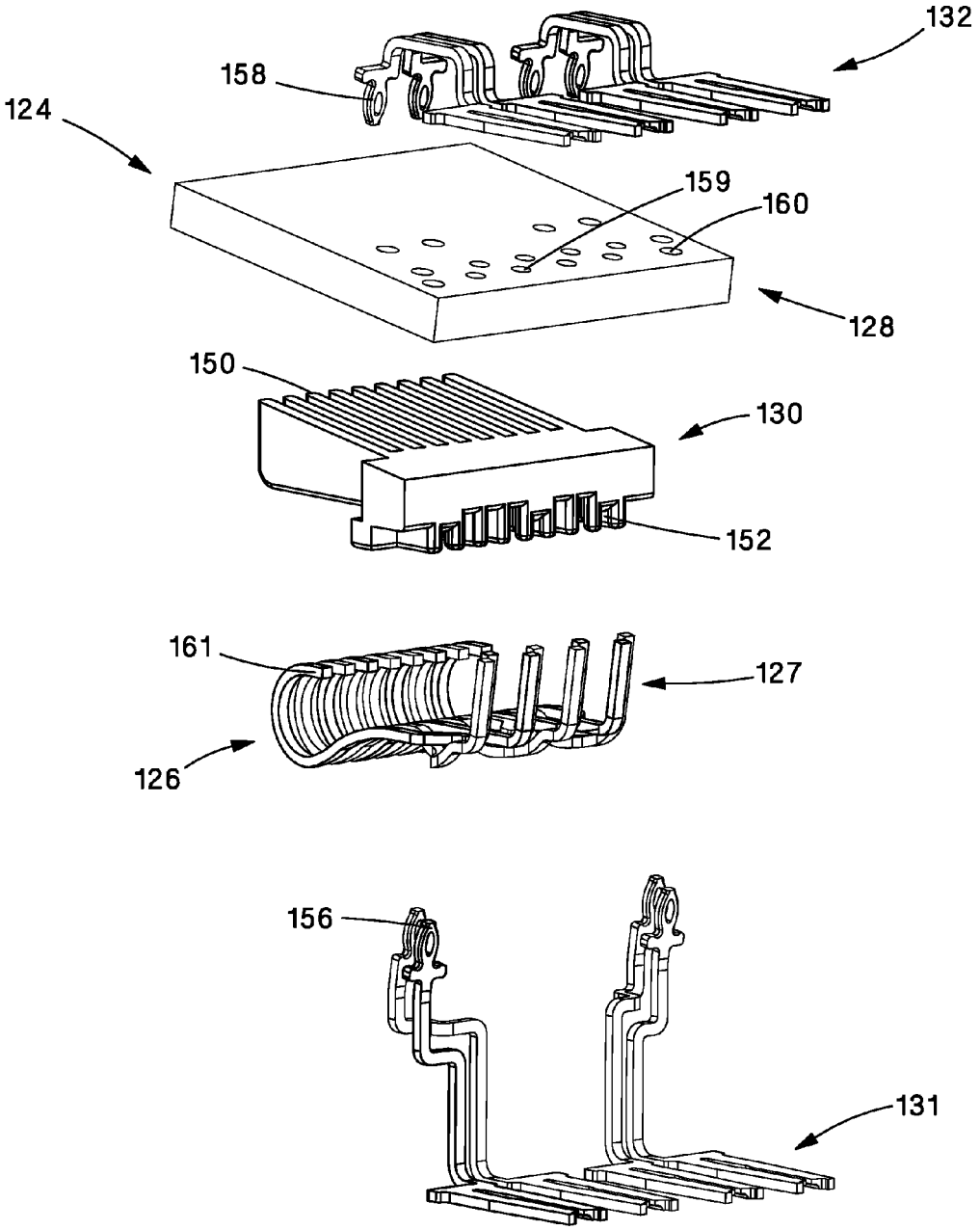

The multi-mode operational nature of jack 114 is also enabled by the design of the sled assembly 124 which allows plugs with different plug contact configurations to be mated thereto. As shown in FIGS. 11-13, the sled assembly 124 includes a plurality of PICs 126, PCB 128, sled support 130 with front combs 150 that control the separation of PICs 126 during operation support features 152 that secure and align PICs 126 during operation, and IDCs 131 and 132 which are secured to PCB 128 by way of compliant pins 156 and 158 being secured in respective vias 160. PICs 126 are secured to the PCB 128 through the PICs' base sections 127 which are positioned and secured in the respective vias 159. Vias 159 and internal PCB circuitry that connects vias 159 to IDCs 131,132 provide an electrical path from PICs 126 to IDCs 131,132. At the opposite end of the PICs 126, in the jack's default state, PIC contact legs 161 are positioned some distance away from the PCB 160 and the corresponding PCB pads 162. Being cantilevered allows PICs 126 to have a relatively large degree of travel, allowing them to interface with different types of plug contacts, such as those present in the plug 116.

Figure 14:
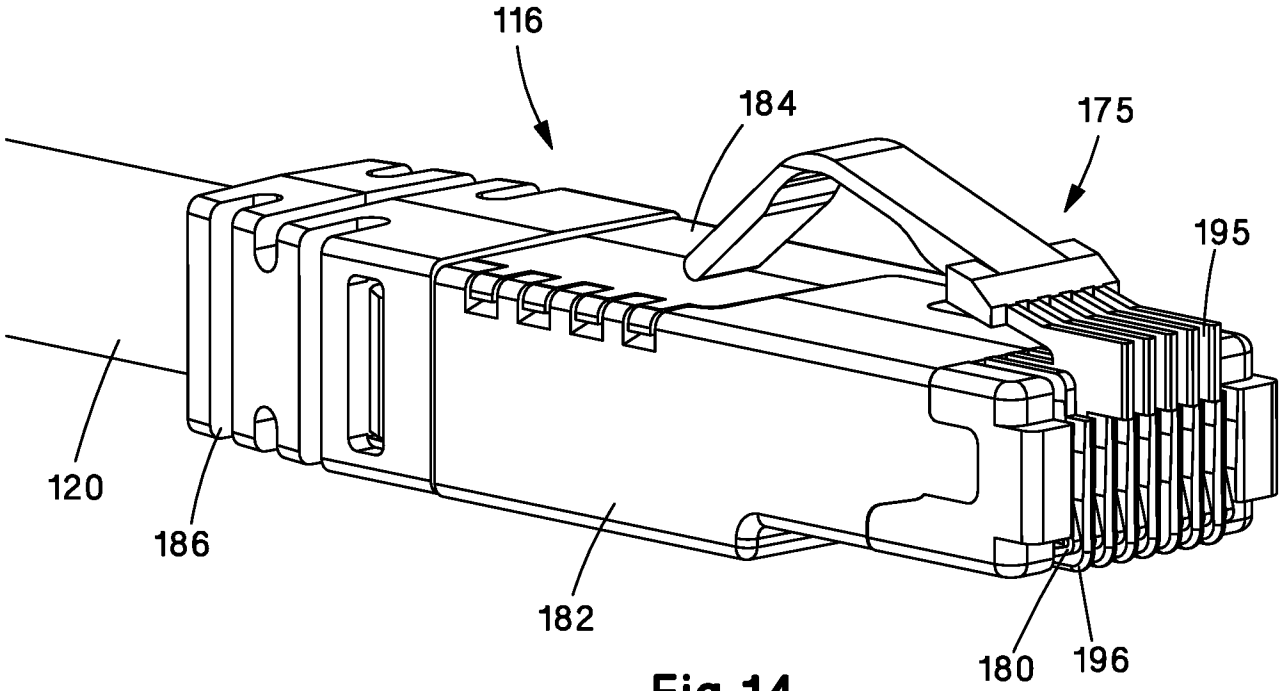
FIG. 14 illustrates a plug in accordance with an embodiment of the present invention.
Figure 15:
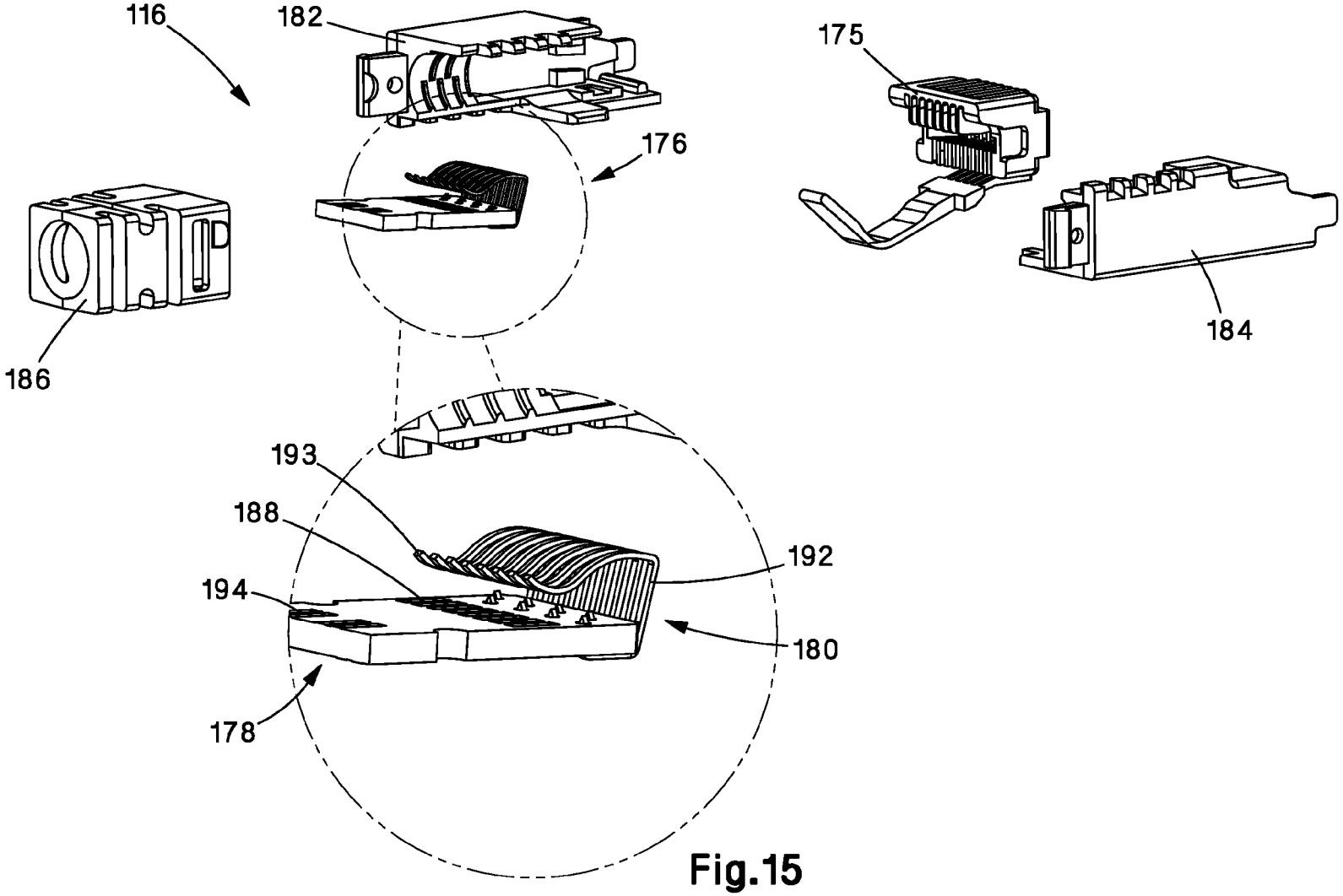
FIGS. 15-17 illustrate isometric exploded views of the plug of FIG. 14.
Figure 16:
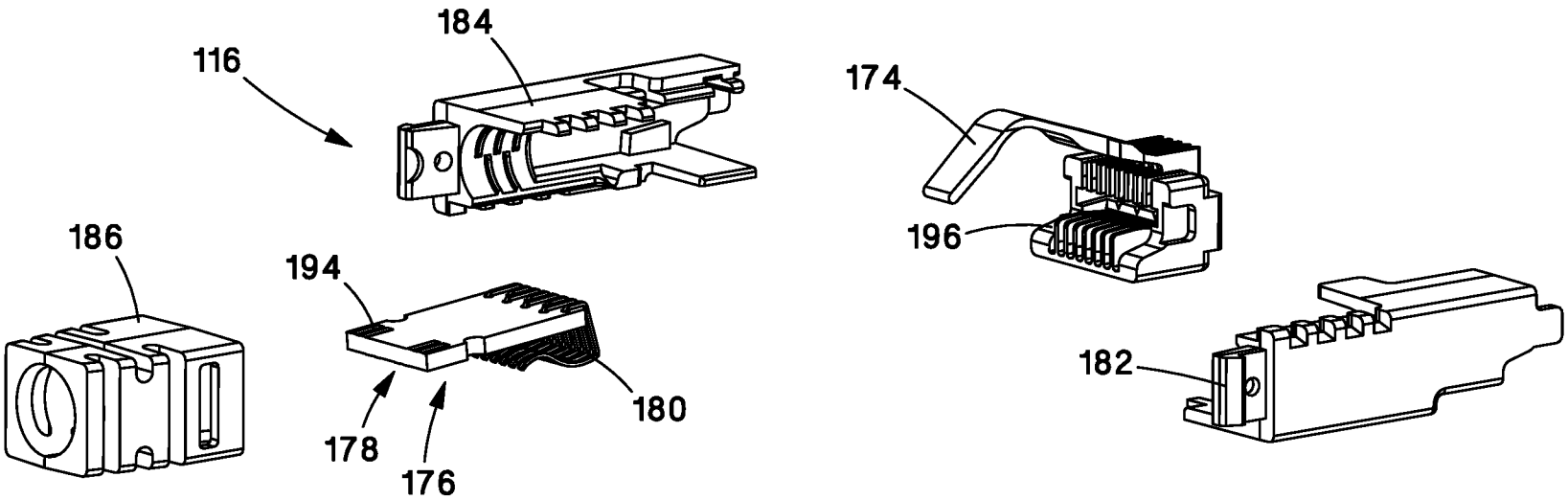
Figure 17:
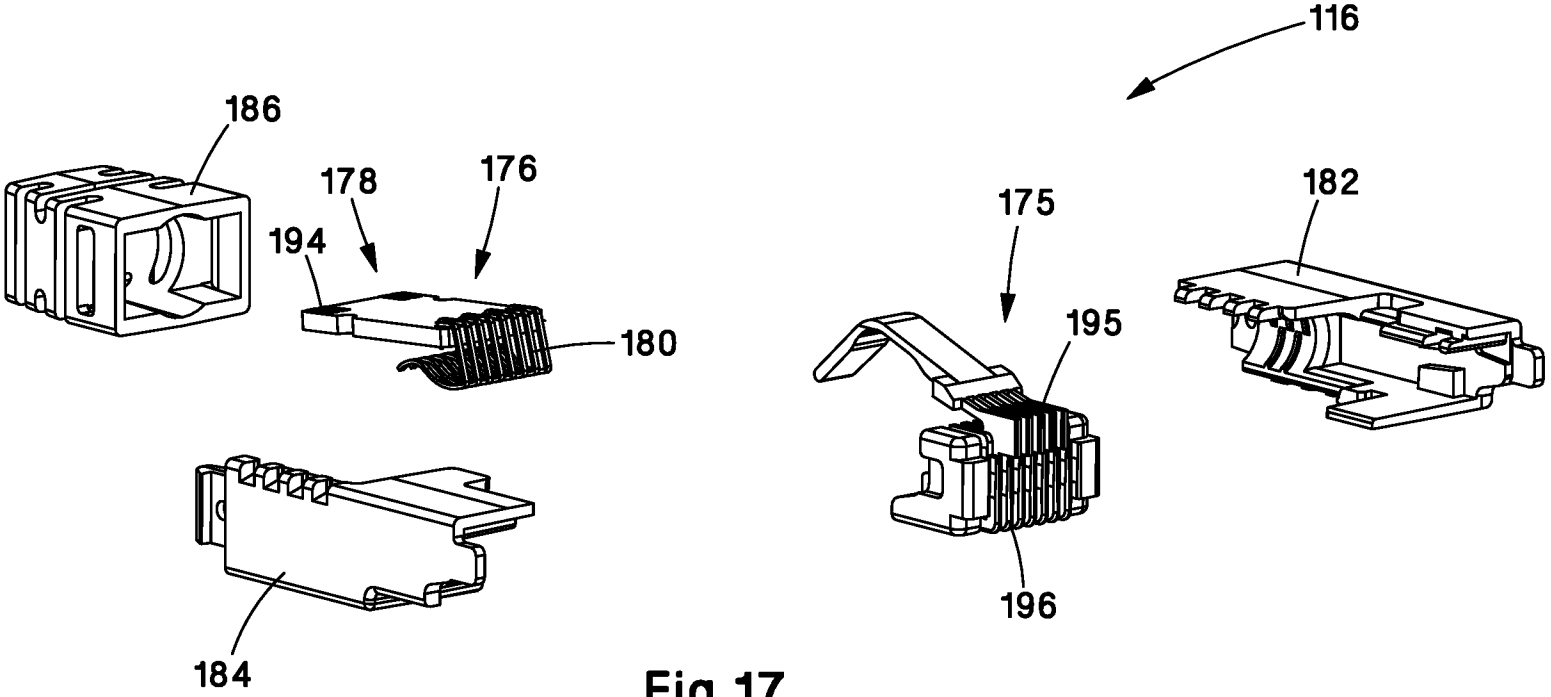

An isometric view of an exemplary embodiment of plug 116 is shown in FIG. 14 with FIGS. 15-17 showing exploded views of the same plug 116. As shown therein, plug 116 includes front housing 175, left housing 182, right housing 184, and bend radius control boot 186. Internally, the plug includes a PCB assembly 176 which is comprised of a plug PCB 178 and plug contacts 180. PCB assembly 176 has a particular design which enables the plug to function in one of two modes. The first mode of operation essentially turns plug 116 into a fully IEC-60603-7:2010 compatible plug capable of producing appropriate levels of NEXT and/or FEXT as required by some pre-existing standards. The second mode of operation allows the same plug 116 to mate with a non-standardized jack (or a jack capable of operating pursuant to a non-standardized mode of operation such as jack 114) and utilizing alternate circuit components to enable improved electrical performance. This multi-mode operation can be achieved by having plug contacts with multiple plug/jack mating points, where each mating point corresponds to a different set of circuit components utilized between the respective mating point and contact pads 194 used for connecting plug 116 to cable 120.

In the presently described embodiment, plug contacts 180 are designed to alternate between two physical states, each corresponding to a particular mode of operation. In particular, each plug contact has a static portion and a dynamic portion. The static portion includes a base section 181 that is secured in the PCB 178 and a first static section 183 that runs near a first surface of the PCB 178. The dynamic portion includes a contact arm 192 and a contact leg 193. Each first static section is linked to a respective contact arm via a flexible section 197, allowing the dynamic portion of the plug contact to exhibit displacement (in this case rotational) relative to the flexible section. To provide support from over-rotation/over-displacement of the dynamic portion and/or to provide appropriate structural rigidity to the plug contacts when operating in the first mode of operation, contact arm 192 can be positioned such that when the plug is operating in the first mode of operation, said contact arm 192 comes into contact with a stop surface, which in the current embodiment is a second surface of the PCB 178. To help with retaining plug contacts 180 in their appropriate locations, front housing 175 includes combs 193 and 195.

Figure 18:
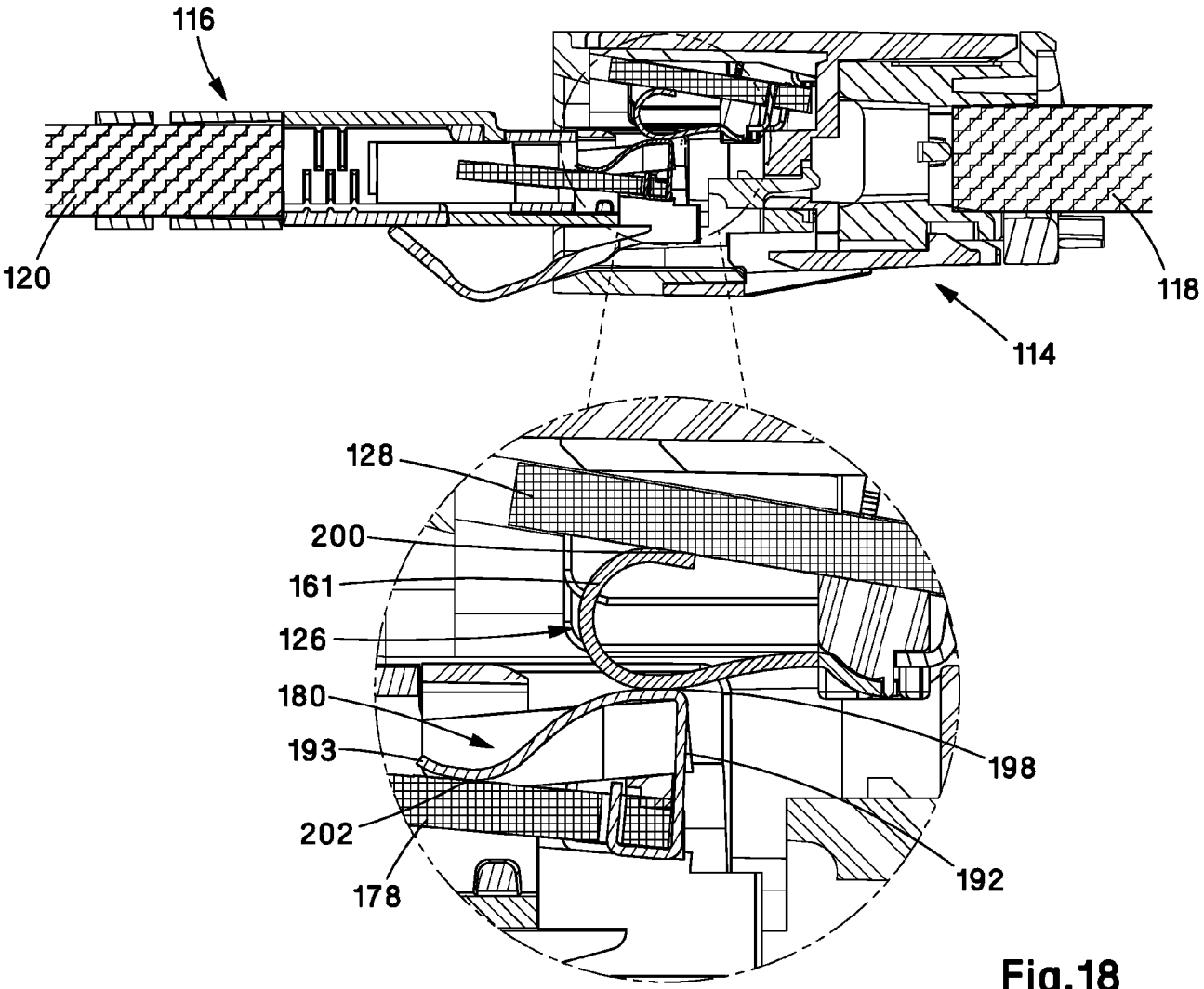
FIG. 18 illustrates a section view of a network jack mated with a network plug with both components operating in their respective first modes.

FIG. 18 illustrates a section view of network jack 114 mated with network plug 116 with both components operating in their respective first modes.

For plug 116, each plug contact 180 makes contact with a respective PIC 126 at a first plug/jack interface point 198. Due to the interaction with the PICs, contact arms 192 of plug contacts 180 are deflected (in this case approximately 15 degrees) from their default positions. This deflection causes contact legs 193 of plug contacts 180 to make contact with front PCB pads 188 of plug PCB 178 at contact point 202, thereby establishing a data transmission path that employs a first set of circuit components between the first plug/jack interface point 198 and rear PCB pads 194. In the first mode of operation, physical characteristics of plug 116 comply with the requirements of the IEC-60603-7:2010 standard. Furthermore, the circuit components used in this mode may contain crosstalk circuitry (capacitive and/or inductive) which can be tuned so that when operating in the first mode of operation, plug 116 complies with ANSI/TIA-568-C.2 crosstalk requirements.

With respect to the jack 114, the same plug contact 180/PIC 126 interaction causes PICs 126 to be deflected away from the plug contacts 180 until PIC contact legs 161 come into contact with PCB pads 162 at contact point 200. Given that circuit components can be connected to PCB pads 162, the transmission path between the first plug/jack interface point 198 and IDCs 131, 132 can be configured such that jack 114 would compensate for an RJ45 plug complying with the crosstalk magnitude requirement of ANSI/TIA-568-C.2.

Figure 19:
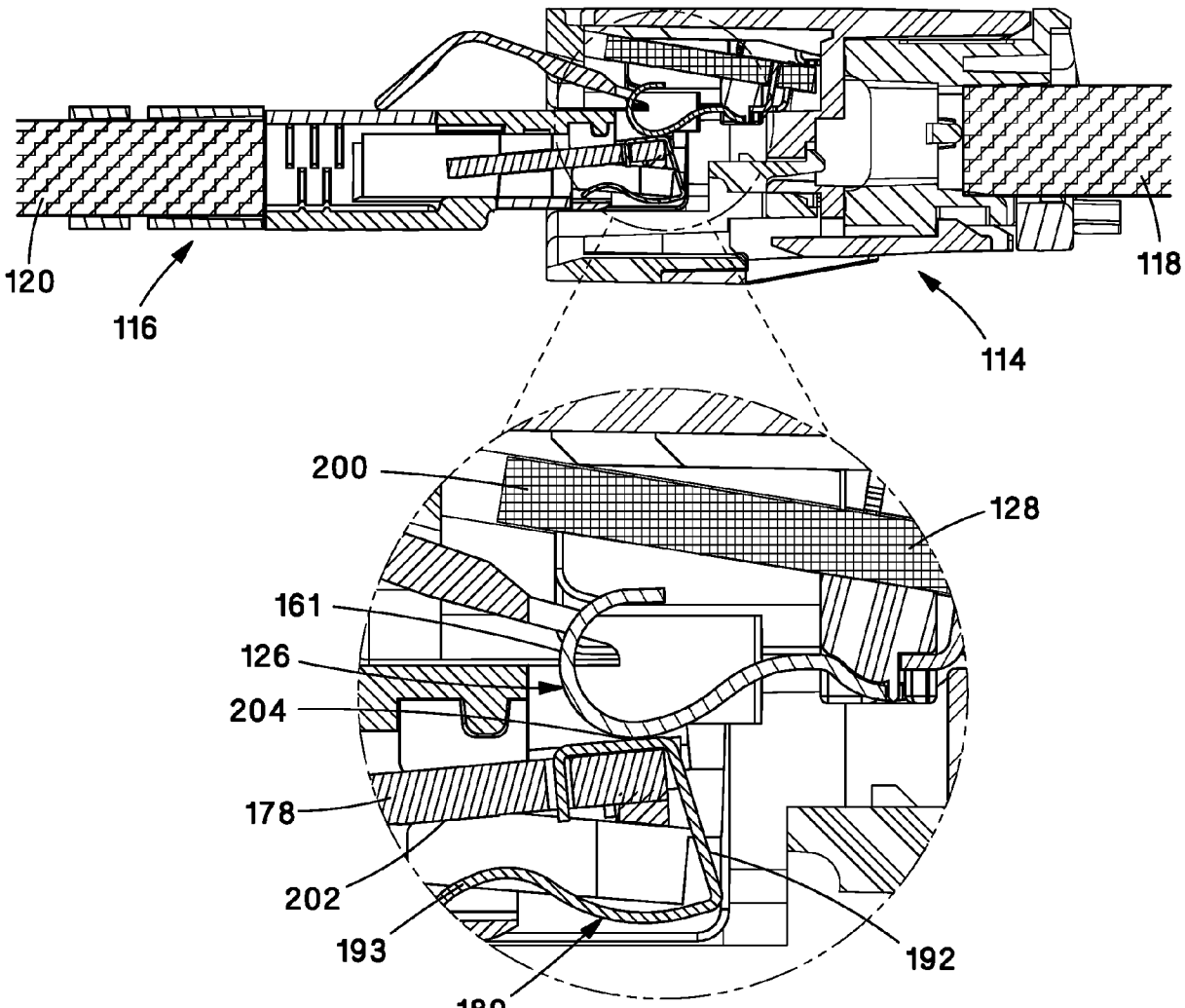
FIG. 19 illustrates a section view of a network jack mated with a network plug with both components operating in their respective second modes.

FIG. 19 illustrates a section view of network jack 114 mated with network plug 116 with both components operating in their respective second modes.

For plug 116, each plug contact 180 makes contact with a respective PIC 126 at a second plug/jack interface point 204. Since point 204 occurs along a static portion of plug contacts 180 and contact arms 192 along with contact legs 193 are not interfered with, contact arms 192 remain in their deflected position and contact legs 193 are suspended some distance away from PCB pads 188. In the second mode of operation, physical characteristics of plug 116 do not have to comply with the requirements of the IEC-60603-7:2010 standard (e.g., characteristics of plug contacts 180). Furthermore, since contacts 180 are no longer in contact with PCB pads 188, circuitry involved in the transmission of the signal is different from the circuitry that is activated during the first mode of operation (e.g., circuit components connected to PCB pads 188 are no longer active). This may allow one to tune the plug such that when it operated in the second mode of operation, it does not necessarily comply with ANSI/TIA-568-C.2 crosstalk requirements.

Due to plug contacts 180 being noncompliant with IEC-60603-7:2010, PICs 126 of jack 114 must adjust accordingly. Since, as described previously, PICs 126 have a relatively large range of motion between their default state and their fully deflected state, this wide range can enable adequate mating with plug contacts that are noncompliant with IEC-60603-7:2010. As shown in FIG. 19, when mated with plug 116 in a second mode of operation, PICs 126 still make contact with plug contacts 180 of plug 116. However, due to the second plug/jack interface point 204 being positioned differently from the first plug/jack interface point 198, PICs 126 are deflected less than they were when jack 114 operated in the first mode of operation. As a result, PIC contact legs 161 do not come into contact with PCB pads 162. This modifies the circuitry involved in the transmission of the signal through jack 114 during the second mode of operation (as compared to the first mode of operation) (e.g., circuit components connected to PCB pads 162 are no longer active). This may make it possible to tune the jack such that in the second mode of operation it compensates for crosstalk that is not ANSI/TIA-568-C.2 compliant.

Figure 20:
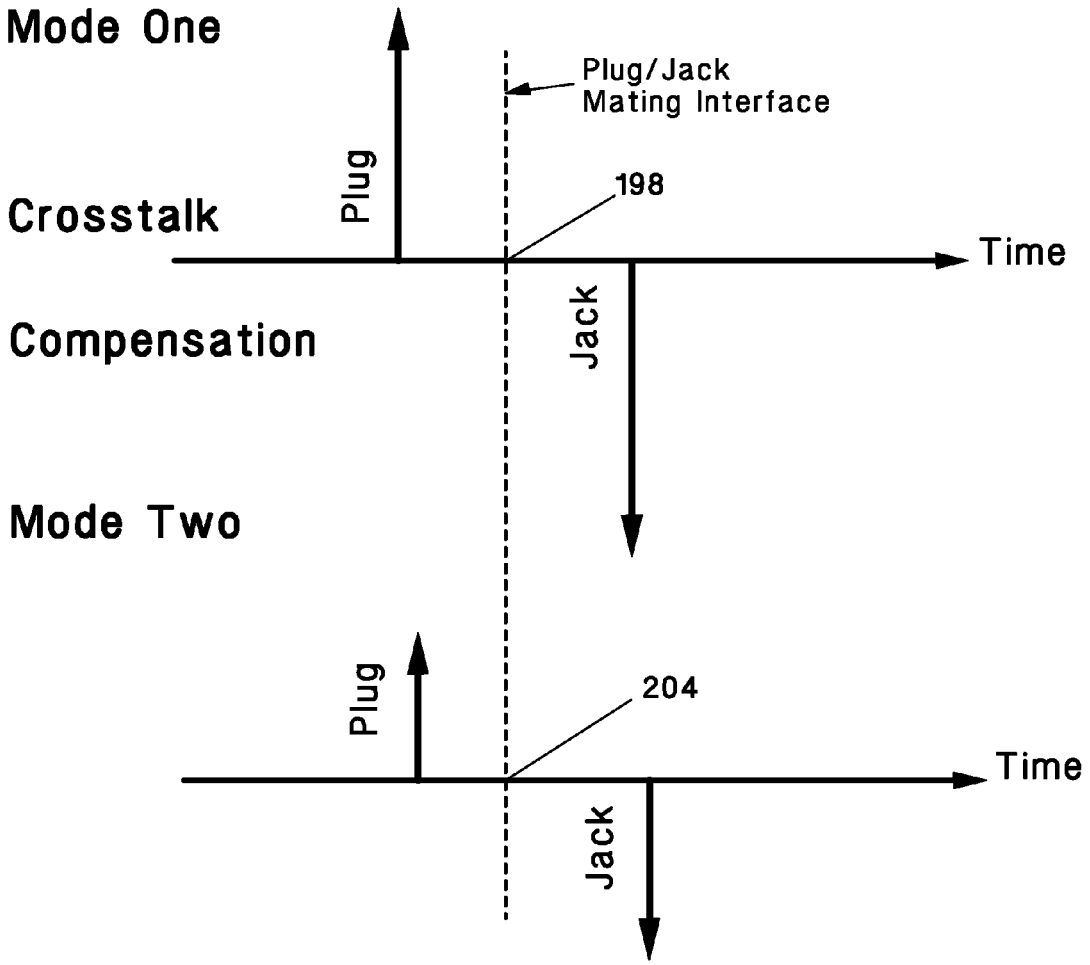
FIG. 20 illustrates a lumped vector representation of crosstalk resulting from a mated combination of a network jack and a network plug in different modes of operation.

FIG. 20 is a lumped vector representation of the crosstalk produced by plug 116/jack 114 combination operating in two different modes. As one can tell from this figure, the respective crosstalk in both the plug 116 and jack 114 is greater when the combination is operating in mode one rather than when operating in mode two. This can be significant because compensating for greater levels of crosstalk becomes more difficult with increased operating frequencies. As operating frequencies increase, the physical distance between the plug's crosstalk and jack's crosstalk causes a phase shift to occur in the compensation signal provided by the jack. Consequently, sufficient cancellation of plug's crosstalk becomes difficult, if not all together impossible. With a lower crosstalk magnitude, the inherent phase shift results in lower signal degradation. Thus, when operating in the second mode, the plug/jack combination may be able to operate at higher operating frequencies while still having each part (i.e., plug and/or jack) be backwards compatible with common standards.

Figure 21:
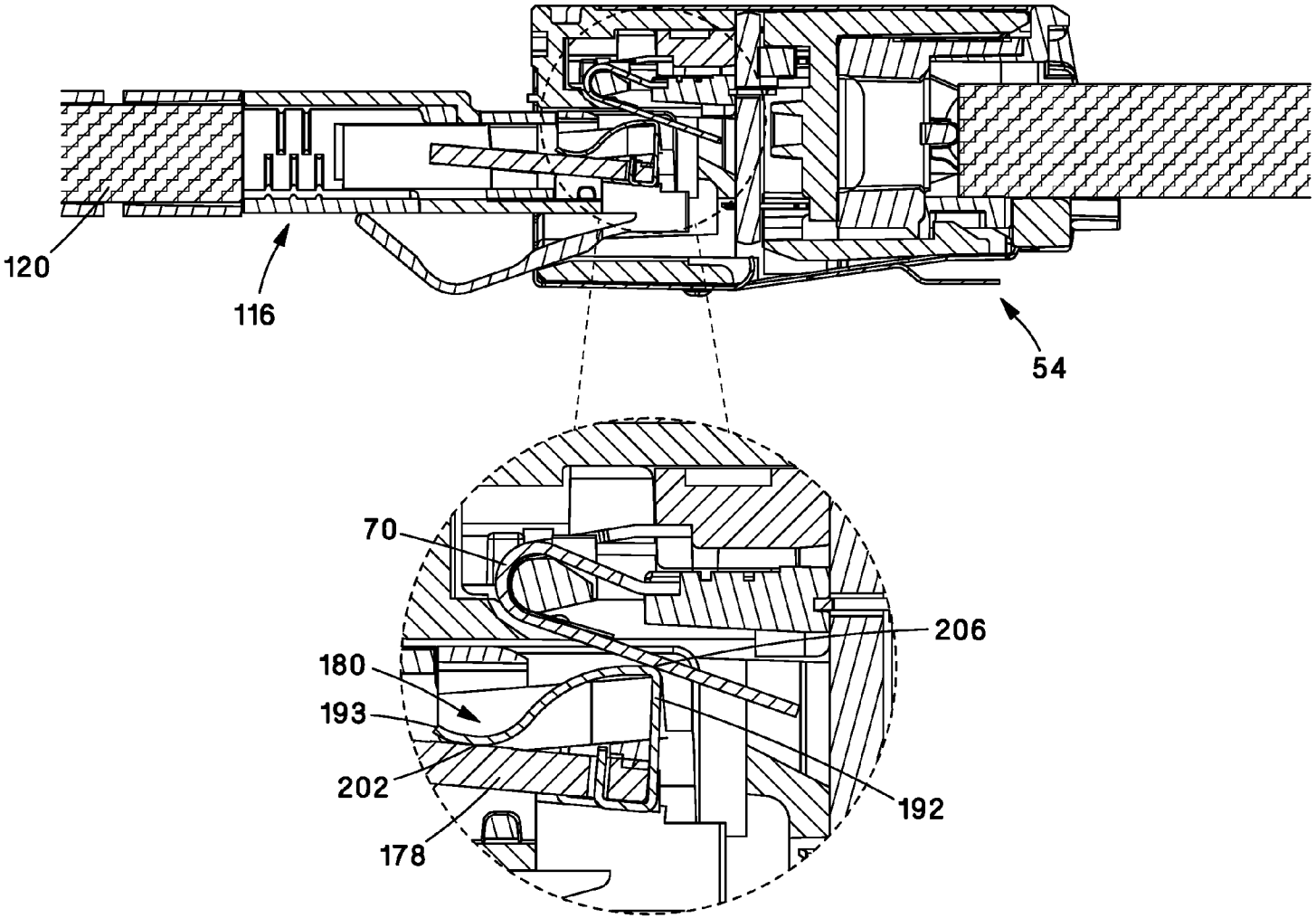
FIG. 21 illustrates a section view of a network plug according to an embodiment of the present invention mated with a conventional RJ45 jack.

An example of plug 116 being used with a common RJ45 jack 54 is shown in a section view illustrated in FIG. 21. In this case, plug 116 is said to operate in its first mode of operation utilizing the dynamic portions of the PICs to make contact with respective PICs 70 of jack 54 at interface points 206. Similar to operating in a first mode of operation while mating with jack 114, when mated with jack 54 contact arms 192 of plug contacts 180 are deflected from their default positions. This deflection causes contact legs 193 of plug contacts 180 to make contact with front PCB pads 188 of plug PCB 178 at contact point 202, thereby establishing a first data transmission path between the first plug/jack interface point 198 and rear PCB pads 194. Since in this mode of operation, physical characteristics of plug 116 comply with the requirements of the IEC-60603-7:2010 standard and electrical characteristics comply with the ANSI/TIA-568-C.2 crosstalk requirements, plug 116 can be successfully mated (making it backwards compatible) with a conventional RJ45 jack designed to cancel appropriate amounts of crosstalk as dictated by ANSI/TIA-568-C.2.

Figure 22:
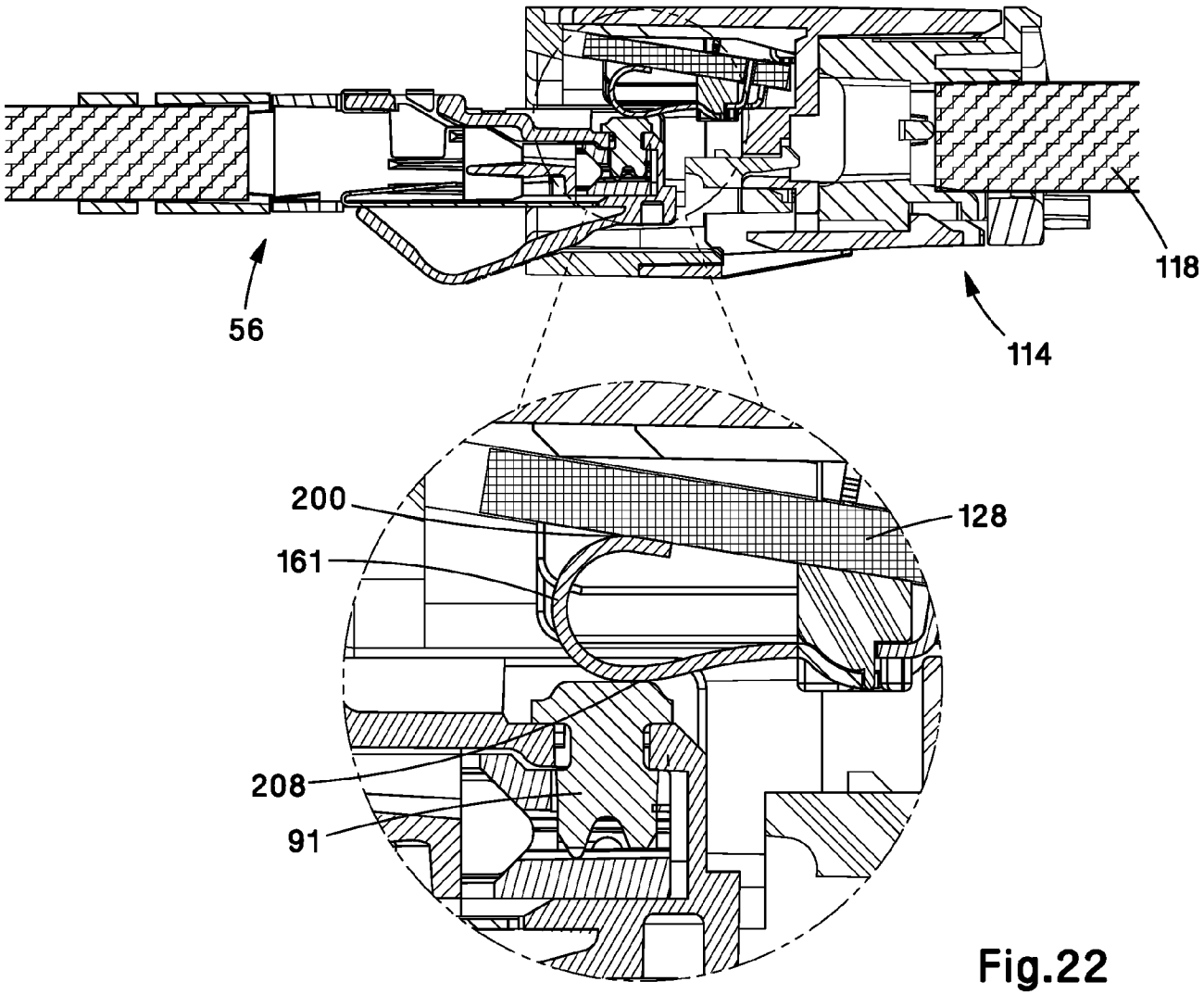
FIG. 22 illustrates a section view of a network jack according to an embodiment of the present invention mated with a conventional RJ45 plug.

Likewise, jack 114 can be mated with a conventional RJ45 plug 56 as shown in the section view illustrated in FIG. 22. In this case, jack 114 is said to operate in its first mode of operation. Similar to operating in a first mode of operation while mating with plug 116, when mated with plug 56 the interaction between PICs 126 and plug contacts 91 causes PICs 126 to be deflected away from the plug contacts 91 until PIC contact legs 161 come into contact with PCB pads 162 at contact point 200. This allows data to be transmitted through the jack 114 (by way of PICs 126) while utilizing the circuitry (that can be tuned to cancel crosstalk generated in a common RJ45 plug as specified by ANSI/TIA-568-C.2) that includes any circuit components connected to pads 162. This allows jack 114 to be backwards compatible with common RJ45 plugs standardized pursuant to at least some existing standards.

It is worth noting that as flipping between mode one and mode two operations flips the polarity of the connection (i.e. conductor one becomes conductor 8 and vice versa), there may be some instances that would require either the plug or jack to be wired in opposite polarity to ensure wire mapping on the overall channel. Alternatively, polarity correcting circuitry may be employed in either of the plug or the jack.

Figure 23:
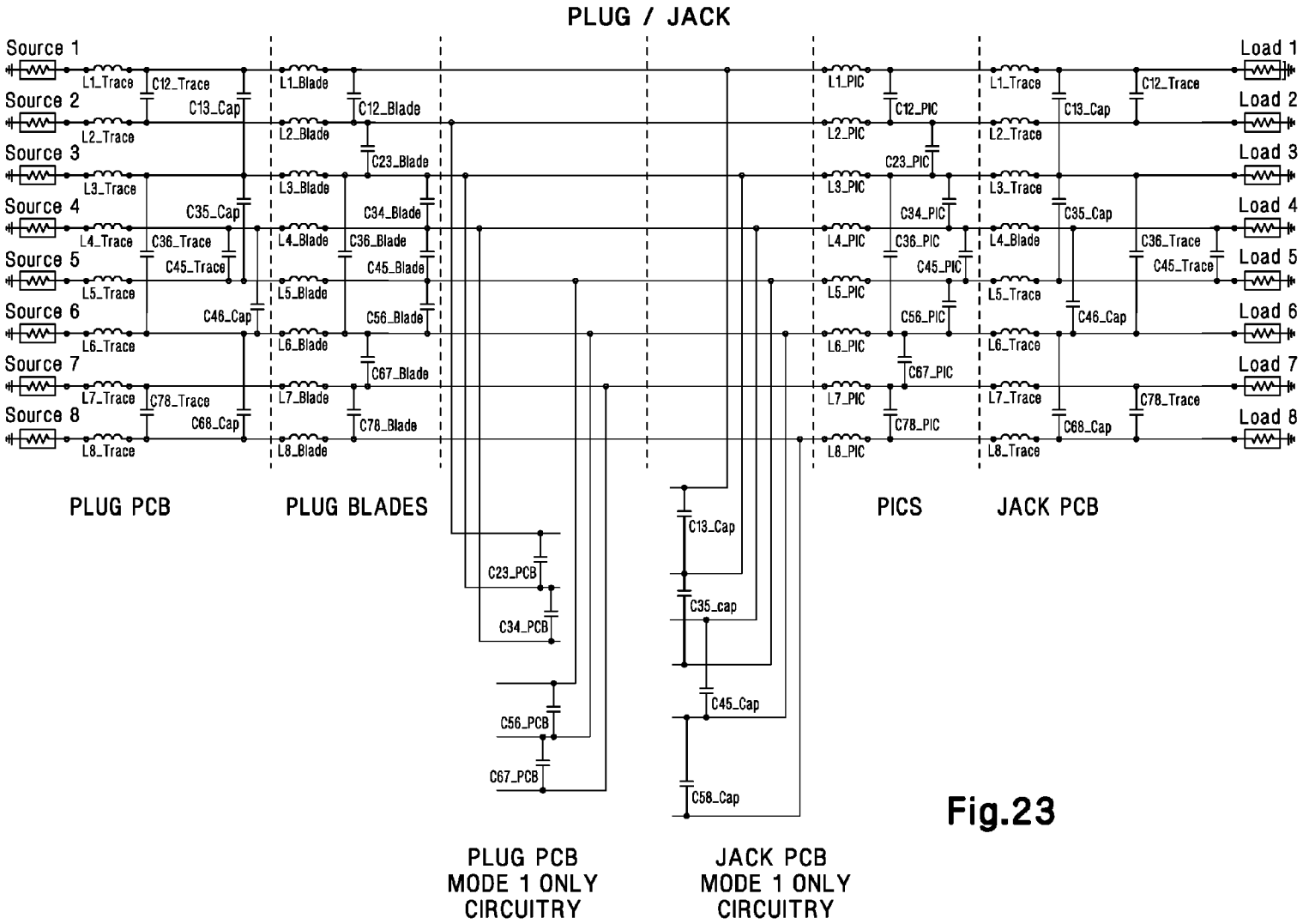
FIG. 23 illustrates an exemplary schematic representing a mated plug/jack connector combination in accordance with the present invention.

An exemplary schematic representing a mated plug/jack connector combination is shown in FIG. 23. As shown therein, section labeled "PLUG PCB MODE 1 ONLY CIRCUITRY" is activated only when the plug is used in its first mode. When operating in the second mode, this section of the circuitry is absent. Likewise, section labeled "JACK PCB MODE 1 ONLY CIRCUITRY" is activated only when the jack is used in its first mode. When operating in the second mode, this section of the circuitry is absent.

Note that while this invention has been described in terms of several embodiments, these embodiments are non-limiting (regardless of whether they have been labeled as exemplary or not), and there are alterations, permutations, and equivalents, which fall within the scope of this invention. For example, while references have been made to rigid PCBs, one of ordinary skill in the art would recognize that the use of flexible PCBs or combinations of flex/rigid PCBs would also be within the scope of the disclosure. Moreover, those of ordinary skill will recognize that embodiments of the present invention can be applied to and/or implemented in a variety of shielded communications cables, including without limitation CAT5E, CAT6, CAT6A, CAT7, CAT8, and other twisted pair Ethernet cable, as well as other types of cable. As such, various known crosstalk production and/or compensation schemes may be used in the respective designs of the plug and the jack. Additionally, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

I claim:

1. A communication system comprising:

a communication plug including a plug housing and a plurality of plug contacts positioned at least partially within said plug housing; and a communication jack including a jack housing and a plurality of plug interface contacts (PICs) at least partially positioned within said jack housing, said communication plug and said communication jack being configured to mate together in a first configuration where each of said plug contacts interfaces one of said PICs along said respective plug contact's first section, said communication plug and said communication jack being further configured to mate together in a second configuration where each of said plug contacts interfaces one of said PICs along said respective plug contact's second section, said second section being different than said respective first section;

wherein said communication plug includes a plug printed circuit board (PCB) with a plurality of plug PCB contact pads, each of said plug contacts having a plug-contact base portion secured within said plug PCB and a plug-contact contact leg, wherein said communication jack includes a jack PCB with a plurality of jack PCB contact pads, each of said PICs having a PIC base portion secured within said jack PCB and a PIC contact leg, wherein in said first configuration each of said plug-contact contact legs is in contact with one of said plug PCB contact pads, and each of said PIC contact legs is in contact with one of said jack PCB contact pads, and wherein in said second configuration each of said plug-contact contact legs is disconnected from each of said plug PCB contact pads, and each of said PIC contact legs is disconnected from each of said jack PCB contact pads.

2. The communication system of claim 1, wherein said communication plug further comprises a plurality of plug-cable contacts, wherein in said first configuration each of said plug PCB contact pads is in electrical communication with one of said plug-cable contacts, and wherein in said second configuration none of said plug PCB contact pads is in electrical communication with one of said plug-cable contacts.

3. The communication system of claim 1, wherein said communication jack further comprises a plurality of jack-cable contacts, wherein in said first configuration each of said jack PCB contact pads is in electrical communication with each of said jack-cable contacts, and wherein in said second configuration none of said jack PCB contact pads is in electrical communication with one of said jack-cable contacts.

4. The communication system of claim 1, wherein in said first configuration said communication plug complies with at least one of an IEC-60603-7:2010 standard and an ANSI/TIA-568-C.2 standard, and wherein in said second configuration said plug does not comply with at least one of said IEC-60603-7:2010 standard and said ANSI/TIA-568-C.2 standard.

5. The communication system of claim 1, wherein in said first configuration said communication plug is inserted into said communication jack in a first orientation, and wherein in said second configuration said communication plug is inserted into said communication jack in a second orientation.

6. The communication system of claim 5, wherein in said second orientation said communication plug is rotated 180 degrees along a plug's longitudinal central axis relative to said first orientation.

7. A communication jack configured to alternately mate with one of a first type of a communication plug configuration and a second type of a communication plug configuration, said communication jack comprising:

a housing; a printed circuit board (PCB) having a plurality of contact pads; and a plurality of plug interface contacts (PICs), at least one of said PICs being in contact with one of said contact pads such that said one of said contact pads is off a current path when said communication jack is mated with said first type of a communication plug configuration, and said at least one of said PICs being disconnected from respective said one of said contact pads when said communication jack is mated with said second type of a communication plug configuration;

wherein said communication plug includes a plug printed circuit board (PCB) with a plurality of plug PCB contact pads, each of said plug contacts having a plug-contact base portion secured within said plug PCB and a plug-contact contact leg, wherein said communication jack includes a jack PCB with a plurality of jack PCB contact pads, each of said PICs having a PIC base portion secured within said jack PCB and a PIC contact leg, wherein in said first configuration each of said plug-contact contact legs is in contact with one of said plug PCB contact pads, and each of said PIC contact legs is in contact with one of said jack PCB contact pads, and wherein in said second configuration each of said plug-contact contact legs is disconnected from each of said plug PCB contact pads, and each of said PIC contact legs is disconnected from each of said jack PCB contact pads.

8. The communication jack of claim 7, wherein said first type of a communication plug configuration is an RJ45 communication plug configuration.

9. The communication jack of claim 7, further comprising a plurality of cable contacts, at least one of said cable contacts being in contact with said one of said contact pads when said communication jack is mated with said first type of a communication plug configuration, and said at least one of said cable contacts being disconnected from said one of said contact pads when said communication jack is mated with said second type of a communication plug configuration.

10. The communication jack of claim 7, further comprising crosstalk compensation circuitry, said crosstalk compensation circuitry configured to produce a first amount of crosstalk when said communication jack is mated with said first type of a communication plug configuration, and said crosstalk compensation circuitry configured to produce a second amount of crosstalk when said communication jack is mated with said second type of a communication plug configuration, said first amount of crosstalk being different than said second amount of crosstalk.

11. The communication jack of claim 7, wherein at least some of said PICs are cantilevered.

12. The communication jack of claim 7, wherein said first type of said communication plug configuration satisfies an IEC-60603-7:2010 standard, and wherein said second type of said communication plug configuration does not satisfy said IEC-60603-7:2010 standard.

13. A communication plug configured to alternately mate with one of a first type of a communication jack configuration and a second type of a communication jack configuration, said communication plug comprising:

a housing; a printed circuit board (PCB) having a plurality of contact pads; and a plurality of plug contacts, at least one of said plug contacts being in contact with one of said contact pads such that said one of said contact pads is off a current path when said communication plug is mated with said first type of a communication jack configuration, and said at least one of said plug contacts being disconnected from respective said one of said contact pads when said communication plug is mated with said second type of a communication jack configuration;

wherein said communication plug includes a plug printed circuit board (PCB) with a plurality of plug PCB contact pads, each of said plug contacts having a plug-contact base portion secured within said plug PCB and a plug-contact contact leg, wherein said communication jack includes a jack PCB with a plurality of jack PCB contact pads, each of said PICs having a PIC base portion secured within said jack PCB and a PIC contact leg, wherein in said first configuration each of said plug-contact contact legs is in contact with one of said plug PCB contact pads, and each of said PIC contact legs is in contact with one of said jack PCB contact pads, and wherein in said second configuration each of said plug-contact contact legs is disconnected from each of said plug PCB contact pads, and each of said PIC contact legs is disconnected from each of said jack PCB contact pads.

14. The communication plug of claim 13, wherein said first type of a communication jack configuration is an RJ45 communication jack configuration.

15. The communication plug of claim 13, further comprising a plurality of cable contacts, at least one of said cable contacts being in contact with said one of said contact pads when said communication plug is mated with said first type of a communication jack configuration, and said at least one of said cable contacts being disconnected from said one of said contact pads when said communication plug is mated with said second type of a communication jack configuration.

16. The communication plug of claim 13, further comprising crosstalk generating circuitry, said crosstalk generating circuitry configured to produce a first amount of crosstalk when said communication plug is mated with said first type of a communication jack configuration, and said crosstalk compensation circuitry configured to produce a second amount of crosstalk when said communication plug is mated with said second type of a communication jack configuration, said first amount of crosstalk being different than said second amount of crosstalk.

17. The communication plug of claim 13, wherein at least some of said plug contacts include a static portion and a dynamic portion.

18. The communication plug of claim 13, wherein said communication plug satisfies an IEC-60603-7:2010 standard when mated with said first type of a communication jack configuration, and wherein said communication plug does not satisfy said IEC-60603-7:2010 standard when mated with said second type of a communication jack configuration.

* * * * *